US005882478A

United States Patent [19]

Schroeder

[11] Patent Number: 5,882,478

[45] Date of Patent: Mar. 16, 1999

[54] TISSUE PRODUCTS CONTAINING ESTERS OF POLYOXYETHYLENE ALKYL ETHER CARBOXYLIC ACIDS

[75] Inventor: Wen Zyo Schroeder, Appleton, Wis.

[73] Assignee: Kimberly-Clark Worldwide, Inc., Neenah, Wis.

[21] Appl. No.: 968,012

[22] Filed: Nov. 12, 1997

[51] Int. Cl.[6] ..... D21H 21/22

[52] U.S. Cl. ..... 162/111; 162/112; 162/135; 162/158; 162/179; 162/183; 162/184

[58] Field of Search ..... 162/111, 112, 162/113, 158, 179, 135, 183, 184

[56] References Cited

U.S. PATENT DOCUMENTS

| | | | |
|---|---|---|---|
| 1,959,930 | 5/1934 | Schmidt et al. | 260/106 |
| 2,234,722 | 3/1941 | Dickey et al. | 28/1 |
| 3,345,300 | 10/1967 | Speel | 252/152 |
| 4,040,900 | 8/1977 | Mazzarella et al. | 162/158 |
| 4,441,962 | 4/1984 | Osborn, III | 162/111 |
| 4,529,447 | 7/1985 | Okada et al. | 106/287.24 |
| 4,632,730 | 12/1986 | Ulubay et al. | 162/111 |
| 4,885,102 | 12/1989 | Yamamura et al. | 252/8.8 |
| 5,290,459 | 3/1994 | Puentes-Bravo et al. | 252/8.6 |
| 5,474,689 | 12/1995 | Laughlin et al. | 252/8.8 |
| 5,494,731 | 2/1996 | Fereshtehkhou et al. | 428/211 |
| 5,575,891 | 11/1996 | Trokhan et al. | 102/111 |
| 5,593,614 | 1/1997 | Laitem et al. | 510/524 |
| 5,753,079 | 5/1998 | Jenny et al. | 162/111 |

*Primary Examiner*—Peter Chin
*Attorney, Agent, or Firm*—Gregory E. Croft

[57] ABSTRACT

The softness of tissue products, such as facial and bath tissue, is improved by the addition of a carboxylic acid ester. The carboxylic acid ester can be incorporated into the tissue by addition of the ester to the furnish prior to the formation of the tissue, or it can be topically applied to the tissue web after formation, either while the tissue web is still wet or after the tissue web has been dried.

11 Claims, No Drawings

TISSUE PRODUCTS CONTAINING ESTERS OF POLYOXYETHYLENE ALKYL ETHER CARBOXYLIC ACIDS

BACKGROUND OF THE INVENTION

In the manufacture of tissue products, such as facial and bath tissues, continual efforts have been made to make the tissues softer and more appealing to the consumer. To this end, chemical addition has been utilized more frequently as the softening effects of a variety of chemicals are discovered. Nevertheless, there remains a need for further improving the feel qualities of such tissues.

SUMMARY OF THE INVENTION

It has now been discovered that a superior tissue with a smooth, silky, soft hand feel can be produced by incorporating into the tissue an aqueous softening composition containing an ester compound of a carboxylic or fatty acid.

Hence, in one aspect, the invention resides in a tissue product comprising an amount of about 0.01 dry weight percent or greater of a carboxylic acid ester having the following general formula:

$$RO(C_3H_6O)_x(CH_2CH_2O)_y-(CH_2)_m-\overset{\overset{\displaystyle O}{\|}}{C}-O-(CH_2CH_2O)_zR'$$

wherein:

R is a straight or branched alkyl group having a carbon chain length of $C_8$–$C_{24}$ or a straight or branched aliphatic group having a carbon chain length of $C_8$–$C_{24}$;

R' is an straight or branched alkyl group having a carbon chain length of $C_1$–$C_{24}$ or a straight or branched aliphatic group having a carbon chain length of $C_8$–$C_{24}$;

m=0–100, more specifically 0–10, and still more specifically 1–6;

x=0–500, more specifically 0–20, and still more specifically 0–10;

y=2–1000, more specifically 2–200, and still more specifically 6–100; and z=0–1000, more specifically 0–200, and still more specifically 0–100.

In another aspect, the invention resides in a method of making a soft tissue product comprising:

(a) depositing an aqueous suspension of papermaking fibers onto a forming fabric to form a wet web; and (b) drying the web to form a tissue sheet, wherein an amount of about 0.01 weight percent of a carboxylic acid ester is applied to the surface of the web, said ester having the following general formula:

$$RO(C_3H_6O)_x(CH_2CH_2O)_y-(CH_2)_m-\overset{\overset{\displaystyle O}{\|}}{C}-O-(CH_2CH_2O)_zR'$$

wherein:

R is a straight or branched alkyl group having a carbon chain length of $C_8$–$C_{24}$ or a straight or branched aliphatic group having a carbon chain length of $C_8$–$C_{24}$;

R' is an straight or branched alkyl group having a carbon chain length of $C_1$–$C_{24}$; or a straight or branched aliphatic group having a carbon chain length of $C_8$–$C_{24}$;

m=0–100, more specifically 0–10, and still more specifically 1–6;

x=0–500, more specifically 0–20, and still more specifically 0–10;

y=2–1000, more specifically 2–200, and still more specifically 6–100; and z=0–1000, more specifically 0–200, and still more specifically 0–100.

In a further aspect, the invention resides in a method of making a soft tissue sheet comprising:

(a) depositing an aqueous suspension of papermaking fibers onto a forming fabric to form a wet web, said aqueous suspension of papermaking fibers comprising 0.01 or greater dry weight percent, based on fiber, of a carboxylic acid ester; and (b) drying the wet web to form a tissue sheet, wherein said carboxylic acid ester has the following general formula:

$$RO(C_3H_6O)_x(CH_2CH_2O)_y-(CH_2)_m-\overset{\overset{\displaystyle O}{\|}}{C}-O-(CH_2CH_2O)_zR'$$

wherein:

R is a straight or branched alkyl group having a carbon chain length of $C_8$–$C_{24}$ or a straight or branched aliphatic group having a carbon chain length of $C_8$–$C_{24}$;

R' is an straight or branched alkyl group having a carbon chain length of $C_1$–$C_{24}$ or a straight or branched aliphatic group having a carbon chain length of $C_8$–$C_{24}$;

m=0–100, more specifically 0–10, and still more specifically 1–6;

x=0–500, more specifically 0–20, and still more specifically 0–10;

y=2–1000, more specifically 2–200, and still more specifically 6–100; and z=0–1000, more specifically 0–200, and still more specifically 0–100.

The carboxylic acid esters useful for purposes of this invention can be synthesized using conventional methods known to those skilled in the chemical arts. Specifically, these compounds can be made by ethoxylation and/or propoxylation of a straight or branched primary alcohol with a carbon chain of $C_8$–$C_{24}$, followed by carboxylation (e.g. the Williamson synthesis) of the resulting alkyloxylated product. Suitable primary alcohols include, but are not limited to, n-octyl, n-nonyl, n-decyl, n-undecyl, n-dodecyl, n-tridecyl, n-tetradecyl, lauryl, oleyl, parmitoleyl, stearyl, isodecyl, isostearyl, and the like. The degree of alkoxylation can be tailored for the desired water solubility. For example, higher degrees of ethoxylation usually yield higher hydrophilic/lipophilic balance (HLB) values. As a result, the compounds disperse or solubilize in water more readily. To obtain satisfactory water solubility, the number of oxyethylene units in any single molecule should be no less than 5–6. In contrast to ethoxylation, increasing the level of propoxylation reduces the water solubility. In general, it is preferable to have no more than 8 units of oxypropylene in one single molecule. The resulting carboxylated acid undergoes a final esterification process where it is reacted with another primary alcohol with a carbon chain length of $C_1$–$C_{24}$ or a fatty alcohol with a carbon chain length of $C_8$–$C_{24}$. In cases where both oxyethylene and oxypropylene units are present in one single molecule, it is preferable to have the degree of ethoxylation/propoxylation be from about 1 to about 20, more specifically from about 2 to about 10, and still more specifically from about 2 to about 6.

The amount of the carboxylic acid ester added can be about 0.01 dry weight percent or greater, based on the weight of fiber. More specifically, the amount can be from about 0.01 to about 5 dry weight percent and, still more specifically, from about 0.05 to about 1 dry weight percent. The carboxylic acid ester can be added to the furnish prior to forming the wet web, or it can be applied to the wet web after formation and before drying, or it can be applied to the dried web. Suitable means for applying the carboxylic acid ester to the web include spraying and printing.

EXAMPLES

Example 1.

A single ply tissue having a basis weight of 16 pounds per 2880 square feet was made with a furnish comprising 60 weight percent eucalyptus fibers and 40 weight percent northern softwood kraft fibers. The furnish was deposited onto a forming fabric in the form of an aqueous suspension to form a wet web. Prior to formation, an imidazolinium-based softener/debonder (C-6027, Witco Corporation) was added to the fiber suspension in an amount of 2 kilograms of softener/debonder per metric ton of fiber. After formation, the wet web was sprayed with an aqueous solution of a carboxylic acid ester of the formula: $C_{12\text{-}15}H_{25\text{-}31}O(C_2H_4O)_8CH_2COOC_3H_7$. The amount of the carboxylic acid ester in the aqueous suspension was about 0.2 weight percent. The add-on amount of the carboxylic acid ester retained on the wet tissue web was about 0.2 dry weight percent based on fiber. The wet web was then throughdried to form a soft tissue. The resulting tissue was softer than both an untreated control tissue and a control tissue containing only the wet end addition of the same imidazolinium-based softener/debonder. The tissue of this invention also had improved surface smoothness.

Example 2.

A single ply tissue having a basis weight of 16 pounds per 2880 square feet was made with a furnish comprising 50 weight percent eucalyptus fibers and 50 weight percent northern softwood kraft fibers. The furnish was deposited onto a forming fabric in the form of an aqueous suspension to form a wet web. After formation, the wet web was sprayed with an aqueous solution of a carboxylic acid ester of the formula: $C_{10}H_{21}O(C_3H_6O)_2(C_2H_4O)_{6\text{-}7}CH_2COOC_3H_7$. The amount of the carboxylic acid ester in the aqueous suspension was about 0.2 weight percent. The add-on amount of the carboxylic acid ester retained on the wet tissue web was about 0.2 dry weight percent based on fiber. The wet web was then throughdried to form a soft tissue. The resulting tissue was softer than the untreated control tissue and had a smooth surface feel.

Example 3.

A 2-ply, wet-pressed, creped tissue was made having a basis weight of about 7.3 pounds per 2880 square feet per ply. The tissue furnish comprised about 60 dry weight percent eucalyptus fibers and about 40 dry weight percent northern softwood kraft fibers. After drying and creping, two like tissue sheets were plied together and crimped together to form the 2-ply tissue. Then both sides of the resulting tissue were printed with an aqueous solution of a carboxylic acid ester using a rotogravure printer.

The carboxylic acid ester had the formula: $C_{12\text{-}15}H_{25\text{-}31}O(C_2H_4O)_8CH_2COOC_3H_7$. The amount of the carboxylic acid ester in the aqueous suspension was about 90–95 weight percent. The add-on amount of the carboxylic acid ester retained on the tissue was from about 1–2 dry weight percent based on fiber. The resulting tissue had a superior surface smoothness and a slick, gliding hand feel compared to the untreated control tissue.

It will be appreciated that the foregoing example, given for purposes of illustration, is not to be construed as limiting the scope of this invention, which is defined by the following claims and all equivalents thereto.

I claim:

1. A tissue product comprising an amount of about 0.01 dry weight percent or greater of a carboxylic acid ester having the following general formula:

$$RO(C_3H_6O)_x(CH_2CH_2O)_y-(CH_2)_m-\overset{\overset{\displaystyle O}{\|}}{C}-O-(CH_2CH_2O)_zR'$$

wherein:

R is a straight or branched alkyl group having a carbon chain length of $C_8$–$C_{24}$ or a straight or branched aliphatic group having a carbon chain length of $C_8$–$C_{24}$;

R' is an straight or branched alkyl group having a carbon chain length of $C_1$–$C_{24}$ or a straight or branched aliphatic group having a carbon chain length of $C_8$–$C_{24}$;

m=0–100;

x=0–500;

y=2–1000; and z=0–1000.

2. The tissue of claim 1 wherein y=2–200.

3. The tissue of claim 1 wherein y=6–100.

4. The tissue of claim 1, 2 or 3 wherein the amount of the carboxylic acid ester is from about 0.01 to about 5 dry weight percent.

5. A method of making a soft tissue product comprising:

(a) depositing an aqueous suspension of papermaking fibers onto a forming fabric to form a wet web; and (b) drying the web to form a tissue sheet, wherein an amount of about 0.01 weight percent of an carboxylic acid ester is applied to the surface of the web, said carboxylic acid ester having the following general formula:

$$RO(C_3H_6O)_x(CH_2CH_2O)_y-(CH_2)_m-\overset{\overset{\displaystyle O}{\|}}{C}-O-(CH_2CH_2O)_zR'$$

wherein:

R is a straight or branched alkyl group having a carbon chain length of $C_8$–$C_{24}$ or a straight or branched aliphatic group having a carbon chain length of $C_8$–$C_{24}$;

R' is an straight or branched alkyl group having a carbon chain length of $C_1$–$C_{24}$ or a straight or branched aliphatic group having a carbon chain length of $C_8$–$C_{24}$;

m=0–100;

x=0–500;

y=2–1000; and z=0–1000.

6. The method of claim 5 wherein the carboxylic acid ester is applied to the dry web.

7. The method of claim 5 wherein the carboxylic acid ester is applied to the wet web.

8. The method of claim 5 wherein the amount of the carboxylic acid ester is from about 0.01 to about 5 weight percent.

9. The method of claim 5 wherein the carboxylic acid ester is also included in the furnish prior to forming the wet web.

10. A method of making a soft tissue sheet comprising:

(a) depositing an aqueous suspension of papermaking fibers onto a forming fabric to form a wet web, said aqueous suspension of papermaking fibers comprising 0.01 or greater dry weight percent, based on fiber, of a carboxylic acid ester; and (b) drying the wet web to form a tissue sheet, wherein said carboxylic acid ester has the following general formula:

$$RO(C_3H_6O)_x(CH_2CH_2O)_y-(CH_2)_m-\overset{\overset{\displaystyle O}{\|}}{C}-O-(CH_2CH_2O)_zR'$$

wherein:

R is a straight or branched alkyl group having a carbon chain length of $C_8$–$C_{24}$ or a straight or branched aliphatic group having a carbon chain length of $C_8$–$C_{24}$;

R' is an straight or branched alkyl group having a carbon chain length of $C_1$–$C_{24}$ or a straight or branched aliphatic group having a carbon chain length of $C_8$–$C_{24}$;

m=0–100;

x=0–500;

y=2–1000; and z=0–1000.

11. The method of claim 10 wherein the amount of the carboxylic acid ester is from about 0.01 to about 5 weight percent.

* * * * *